US007244200B2

(12) United States Patent
Goldberg

(10) Patent No.: US 7,244,200 B2
(45) Date of Patent: Jul. 17, 2007

(54) LACROSSE STICK POCKET CREATOR

(76) Inventor: Harrison G. Goldberg, 646 Chestnut St., Newton, MA (US) 02468

( * ) Notice: Subject to any disclaimer, the term of this patent is extended or adjusted under 35 U.S.C. 154(b) by 57 days.

(21) Appl. No.: 11/132,495

(22) Filed: May 19, 2005

(65) Prior Publication Data

US 2005/0288131 A1 Dec. 29, 2005

Related U.S. Application Data

(60) Provisional application No. 60/582,162, filed on Jun. 23, 2004.

(51) Int. Cl.
*A63B 59/02* (2006.01)
*A63B 65/12* (2006.01)

(52) U.S. Cl. ..... 473/513

(58) Field of Classification Search ..... 473/513, 473/512, 505, 415; 223/78; 463/47.2
See application file for complete search history.

(56) References Cited

U.S. PATENT DOCUMENTS 1,165,216 A * 12/1915 Weflen ..... 463/47.2
5,265,871 A * 11/1993 Hanley ..... 473/415
5,421,493 A * 6/1995 Ebeling, II ..... 223/78
5,425,541 A 6/1995 Ambros
5,492,321 A * 2/1996 Cipriano ..... 473/424
5,638,999 A * 6/1997 Greene ..... 223/78
6,006,962 A * 12/1999 Ebeling, II ..... 233/78
6,138,879 A * 10/2000 Breuner ..... 223/78

OTHER PUBLICATIONS

WebPage Download, Lax.com-Warrior:Pocket Pounder, Mar. 6, 2002, www.lax.com/shop/item.phtml?page=product_610_front.phtml, 3 pages.*
Patent Search of Warrior Lacrosse, Brine Lacrosse and deBeer Lacrosse.

* cited by examiner

*Primary Examiner*—Eugene Kim
*Assistant Examiner*—M. Chambers
(74) *Attorney, Agent, or Firm*—Wolf Greenfield & Sacks

(57) ABSTRACT

A device for shaping the mesh of a lacrosse stick head includes a ball similar in size to a lacrosse ball and carried by an elongated handle. A positioning rod is detachably connected to the handle and adapted to extend transverse to the plane of the head and serve as a fulcrum for pivoting the handle away from the head and driving the ball into the mesh of the head to stretch the mesh and form a pocket in it.

3 Claims, 2 Drawing Sheets

LACROSSE STICK POCKET CREATOR

BACKGROUND OF INVENTION

1. Field of Invention

This invention relates to a device for stretching and forming a pocket in the mesh of a lacrosse stick head. There are presently available two types of devices used for this general purpose. One such device marketed under the name Warrior Pocket Pounder comprises a ball carried on a handle, and it is used to repeatedly strike the mesh in a hammer-like motion so as to break in the mesh. The other known available type device serves to stretch the mesh and thereby form the pocket. In the latter device, a hemispherically shaped ball is carried by a threaded shaft that is in turn assembled on the head of the stick with the shaft disposed essentially perpendicular to the plane of the face of the head, and the shaft is rotated to force the ball into the mesh. The present invention is capable of performing both the pounding and stretching functions and further is easier to mount on the stick head for performing the stretching function.

2. Discussion of Related Art

This application claims the benefit under 35 U.S.C. §120 of U.S. application Ser. No. 60/582,162 entitled LACROSSE STICK POCKET CREATOR filed Jun. 23, 2004, which is herein incorporated by reference in its entirety.

SUMMARY OF INVENTION

The present invention includes a ball essentially equal in size to a regulation lacrosse ball, mounted on the end of an elongated handle that may be tubular in form, and typically molded of a rigid plastic material although it may also be made of wood, metal or other comparable material. The handle may be either solid or hollow and may be made in a wide variety of cross-sectional shapes. A positioning rod is adjustably attached to the handle adjacent the end carrying the ball and the rod extends generally perpendicular to the handle. The positioning rod in use supports the device on the head frame and forms a fulcrum about which the handle is pivoted so as to force the ball into the mesh of the head. In a preferred embodiment of the invention, a number of alternative position are formed in the handle adjacent the end carrying the ball so as to effectively enable the user to change the length of the lever arm for forcing the ball into the mesh and to change the depth of peneteration of the ball into the mesh. The positioning rod is also of a length that exceeds the maximum width of the lacrosse stick head so that it can engage both sides thereof. When the positioning rod is removed, the handle and ball may be used to freely hammer against the mesh so as to break in the material.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
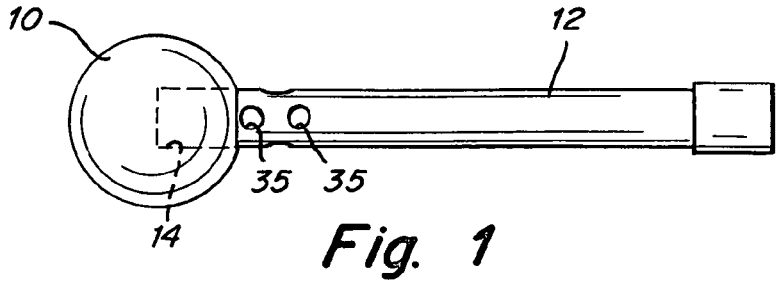
FIG. 1 is a perspective view of the lacrosse stick head shaper constructed in accordance with this invention.
Figure 2:
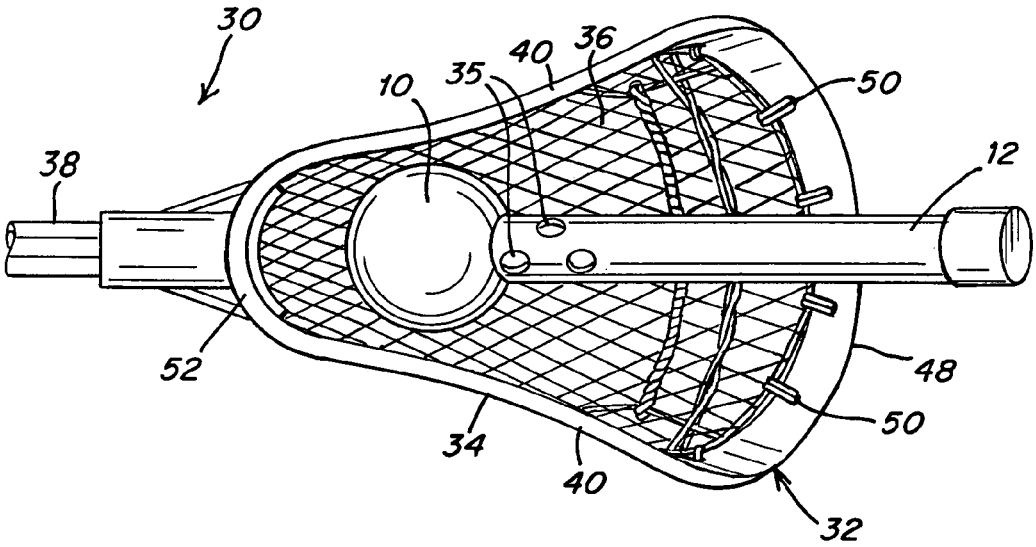
FIG. 2 is a top view of the device shown in FIG. 1 disposed on the head of a lacrosse stick.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

In FIG. 1 the ball 10 and handle 12 of the shaper are shown assembled together. The ball may actually be a lacrosse ball, typically solid and made of a hard rubber or a plastic material. The ball preferably has a diameter of approximately 2 inches. The ball may be made of other materials and need not be a regulation lacrosse ball, although its size should be substantially that of the regulation ball. In the embodiment shown in FIG. 1, a hole 14 is formed in the ball and extends approximately to the ball center. The handle 12 may be tubular or of solid configuration, but must have substantial strength so as not to crack or split, even under the very substantial bending moments that are imposed on it when the device is used to stretch the mesh and form a pocket in the lacrosse stick head. To provide an adequate lever arm when used for stretching the mesh of the lacrosse stick head, the handle preferably is at least 10 inches long from the center of the ball to the opposite free end of the handle. The handle obviously may be made of different lengths so long as it provides adequate leverage for the user.

Figure 3:
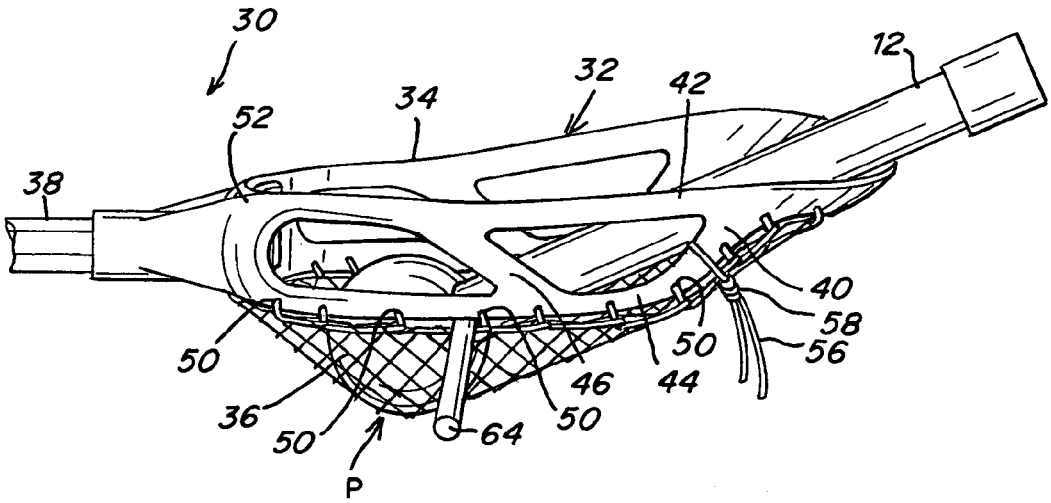
FIG. 3 is a side view of the device positioned in the head of the lacrosse stick as shown in FIG. 2.
Figure 4:
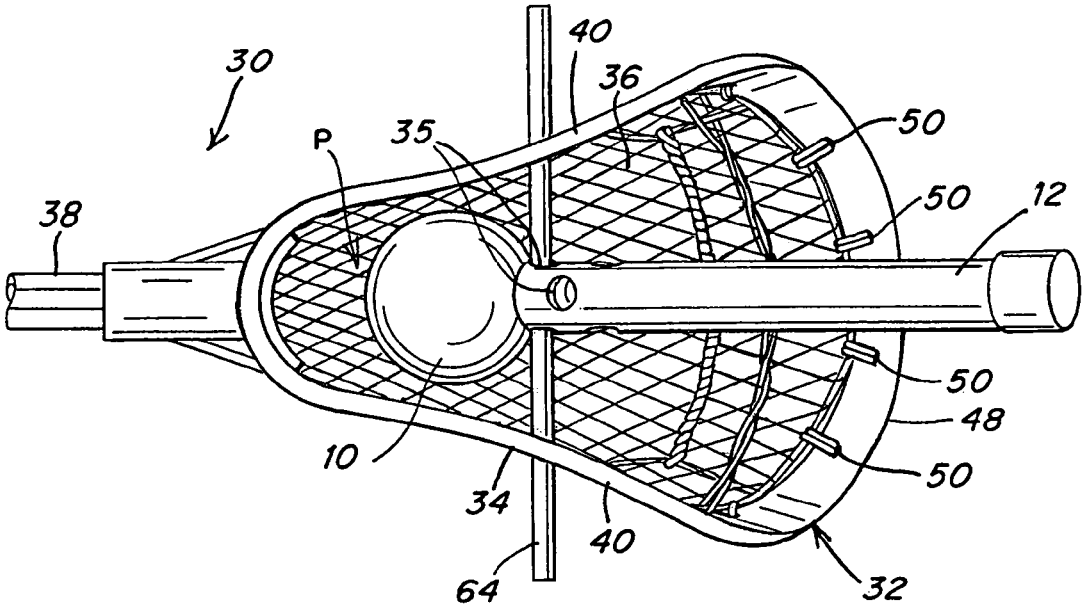
FIG. 4 is a top view similar to FIG. 2, but showing the positioning rod assembled to the device so as to locate the shaper ball in the pocket of the mesh of the head.
Figure 5:
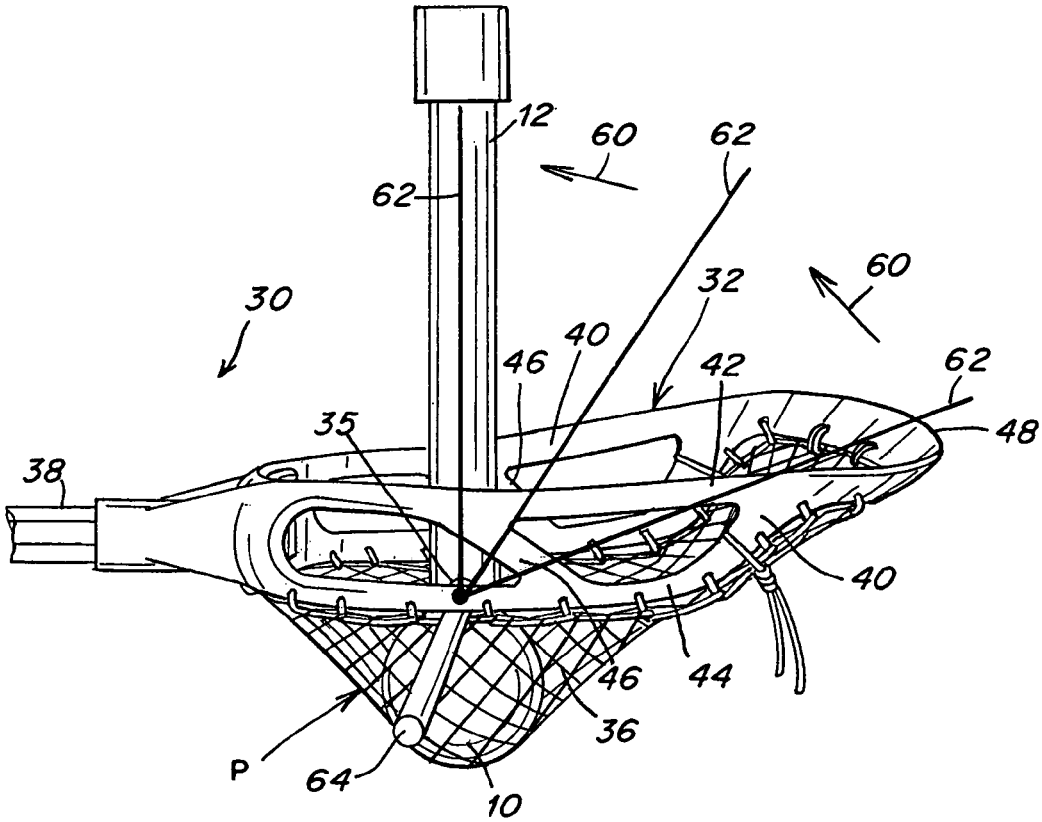
FIG. 5 is a side view of the device and lacrosse stick head shown in FIG. 4 and also showing the manner in which the device is operated to stretch the mesh and form the pocket.

In FIGS. 2-5, the manner in which the device is used is illustrated. In these drawings, a typical lacrosse stick 30 is shown. It includes a head 32 having a generally bell-shaped frame 34, a mesh 36 that shapes the pocket P, and a handle 38. The frame 34 typically is molded of a strong, rigid plastic material that fully encircles the mesh 36 and from which the mesh is suspended. The frame 34 shown is generally bell-shaped, although different lacrosse stick manufacturers employ somewhat different shapes, and the present invention is applicable for preparing the mesh of any lacrosse stick. The sides 40 of the frame of the particular lacrosse stick illustrated have upper and lower segments 42 and 44 joined together by cross-pieces 46 to enhance the strength of the frame. The lower segments 44 on both sides have openings 50 for attachment to the mesh as described below. The outer end 48 of the frame in the lacrosse stick shown is not bifurcated, but rather has one section across that end of the head and is also provided with openings 50 by means of which the mesh is connected to it. The heel 52 of the head is similarly provided with openings 50 for attachment of the mesh. In the lacrosse stick shown, the mesh is attached by means of a cord 56 that is interwoven with the mesh and the openings 50 to hold it in place. The cord is knotted as shown at 58 and enables the slack in the mesh to be reduced when the size of the pocket P formed in the mesh exceeds the maximum pocket size imposed under lacrosse rules. As is shown in FIGS. 3, 4, and 5, the mesh is looser at the heel end 52 of the head so as to form the pocket P. In accordance with the rules of the game, the depth of the pocket P below the bottom sides 44 of the frame cannot exceed the ball diameter, that is, when a ball is placed in the pocket, its upper surface must not lie below the plane of the lower sides 44 of the frame.

When a new mesh 36 is attached to the lacrosse stick by means of the cord 56 which is interwoven with the mesh and the openings 50 in the lower side segments 44, outer end 48 and heel 52 of the frame, the mesh must be broken in so as to form the pocket, and this may be performed by the pounding action described above. That is, the mesh is simply struck by the ball 10 a number of times so as to contour the mesh into the pocket that holds the lacrosse ball. That action may conveniently be performed by the configuration of the present invention shown in FIG. 1 composed simply of the ball 10 and handle 12. In addition, or as an alternative to the pounding of the mesh to form the pocket, the ball and handle in combination with the positioning rod 64 can stretch the mesh to form the pocket. This is achieved by inserting the rod 64 through one side 40 of the frame 34, through one of the holes 35 in the handle 12 and thereafter inserting the end of the rod through the opposite side 40 of the frame, all as suggested in FIGS. 4 and 5. Ideally the frame has openings in its sides to capture the positioning rod while at the same time the central portion of the rod between the sides 40 of the frame is disposed above the mesh so as not to interfere with the stretching of the mesh in a downwardly direction by means of the ball 10.

In FIG. 4 the assembly is shown mounted as described above, and to stretch the mesh to form the pocket, the handle is pivoted upwardly toward a position essentially perpendicular to the plane of the frame as suggested by the arrows 60 and radial lines 62 extending from the axis of the positioning rod provided in FIG. 5. In the embodiment shown, two through-holes are provided in the handle 12 spaced at different distances from the ball 10. Obviously, different numbers of holes may be provided and the rod connection to the handle may take other forms such as a bracket slidable on the handle etc. By passing the positioning rod through the hole further away from the ball, the depth of the pocket will be increased during stretching. Initially the hole in the handle nearer the head is used so as to maximize the length of the lever formed by the handle 12, and thereafter the rod may be transferred to the other hole to increase the pocket depth. As shown in FIG. 4, the holes 35 may be either parallel to one or at an angle to another depending upon the cross-sectional shape of the handle. It will be appreciated that the tool may remain in the operative position when the lacrosse stick is not in use and serve as a form to maintain the desired pocket shape.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A method of stretching and shaping the mesh of the head of a lacrosse stick comprising the steps of:

providing a ball substantially equal in size to that of a regulation lacrosse ball, an elongated handle having one end embedded in and extending radially from the ball, and a positioning rod longer than the maximum width dimension of the stick head for engaging the frame of the head, a cross hole extending transversely through the handle intermediate the handle ends and sized to receive the positioning rod for establishing a fulcrum for pivotally moving the ball into the mesh so as to stretch the mesh and form a pocket by lifting the second end of the handle away from the lacrosse stick head;

attaching the positioning rod in the cross hole so that the rod spans the back face of the head;

placing the rod against opposite sides of the head frame and spanning the back face of the frame with the ball disposed against the front face of the mesh at a location where the mesh is to be shaped so that the rod serves as a fulcrum for pivoting the handle and for driving the ball into the mesh;

and pivoting the end of the handle away from the front face of the head driving the ball into the mesh to cause the ball to stretch the mesh and shape the pocket.

2. The method recited in claim 1 comprising the step of providing a plurality of holes extending transversely through the handle intermediate the handle ends at different distances from the ball and sized to receive the positioning rod for establishing a fulcrum for pivotally moving the ball into the mesh, and attaching the rod in one of the cross holes determined by the extent to which the mesh is to be stretched.

3. A method of stretching and shaping the mesh of the head of a lacrosse stick comprising the steps of:

providing a ball substantially equal in size to that of a regulation lacrosse ball, an elongated handle having one end connected to and extending radially from the ball, and a positioning rod longer than the maximum width dimension of the stick head for engaging the frame of the head, a fitting on the handle intermediate the handle ends for engaging the rod to establish a fulcrum for pivotally moving the ball into the mesh so as to stretch the mesh and form a pocket by lifting the second end of the handle away from the lacrosse stick head;

attaching the rod to the fitting intermediate the rod ends;

placing the rod against opposite sides of the head frame and spanning the back face of the frame with the ball disposed against the front face of the mesh at a location where the mesh is to be shaped so that the rod serves as a fulcrum for pivoting the handle and for driving the ball into the mesh; and pivoting the second end of the handle away from the front face of the head driving the ball into the mesh to cause the ball to stretch the mesh and shape the pocket.

* * * * *